US005518242A

United States Patent [19]

Mahaffey et al.

[11] Patent Number: 5,518,242

[45] Date of Patent: May 21, 1996

[54] CROWNLESS GOLF CLUB

[75] Inventors: Steven J. Mahaffey, Hampden, Mass.; Daniel A. Melanson, Avon, Conn.

[73] Assignee: Lisco, Inc., Tampa, Fla.

[21] Appl. No.: 494,871

[22] Filed: Jun. 26, 1995

Related U.S. Application Data

[63] Continuation-in-part of Ser. No. 281,043, Jul. 27, 1994, Pat. No. 5,429,354.

[51] Int. Cl.[6] ..... A63B 53/04

[52] U.S. Cl. ..... 473/342; 473/350

[58] Field of Search ..... 273/169, 173, 273/167 E, 167 H, 78; D21/214, 215, 220

[56] References Cited

U.S. PATENT DOCUMENTS

| | | | |
|---|---|---|---|
| D. 202,715 | 11/1965 | Solheim | D34/5 |
| D. 208,058 | 7/1967 | Johnston | D34/5 |
| D. 268,357 | 3/1983 | Mader | D21/214 |
| 708,575 | 9/1902 | Mules | 273/78 |
| 777,400 | 12/1904 | Clark | 273/78 |
| 3,880,430 | 4/1975 | McCabe | 273/78 |
| 4,431,192 | 2/1984 | Stuff, Jr. | 273/167 E |
| 4,679,792 | 7/1987 | Straza | 273/78 |
| 4,754,969 | 7/1988 | Kobayashi | 273/78 |
| 4,900,029 | 2/1990 | Sinclair | 273/167 E |
| 5,060,949 | 10/1991 | Brill | 273/167 A |
| 5,174,573 | 12/1992 | Desbiolles et al. | 273/164.2 |
| 5,205,560 | 4/1993 | Hoshi et al. | 273/78 |
| 5,255,913 | 10/1993 | Tsuchida | 273/78 |
| 5,310,185 | 5/1994 | Viollaz | 273/78 |
| 5,429,354 | 7/1995 | Long et al. | 273/167 H X |

OTHER PUBLICATIONS

First Group Auctioneers & Appraisers, "A Golf Memorabilia & Collectibles Auction," Saturday, May 21, 1994, at 12:00 Noon; cover and pertinent pages for Item 51.

*Primary Examiner*—George J. Marlo
*Attorney, Agent, or Firm*—Donald R. Bahr; John E. Benoit

[57] ABSTRACT

A golf club head comprising a striking face section, a sole, and a flange extending about the periphery of the sole. The flange decreases in height from the upper edge of the striking face section to the back edge of the sole. A composition insert is secured within the front of the striking face section. This structure provides a crownless club head. In one modification, the insert has only edge support by the body of the club head. In another modification, the club head is made of a solid material having a high strength/density ratio with no face insert.

3 Claims, 2 Drawing Sheets

CROWNLESS GOLF CLUB

This application is a continuation-in-part of U.S. patent application Ser. No. 08/281,043 filed Jul. 27, 1994, now U.S. Pat. No. 5,429,354.

This invention relates generally to golf clubs, and more specifically to a wood type club which has no crown.

BACKGROUND OF THE INVENTION

Wood type clubs normally used comprise a striking face, a toe, a heel, a sole, and a crown. In the case of metal woods, they are normally hollow and may have additional structure in the interior and also may be filled with a composition or the like.

It is desirable in wood type clubs to attain the maximum performance and yet avoid having clubs which weigh too much and, thus, have a heavy feeling when being used.

One type of club which has been produced relates to an aluminum cast club which has basically no crown and has a scored front face. This club has a standard hosel and the shaft is then mated with the hosel and secured thereto.

The present invention provides an improvement on such a basic crownless club through proper weight distribution, hosel length, face thickness, and the use of a composition insert in the face of the club. Alternately, the club head may be of a solid material having a high strength/density ratio.

SUMMARY OF THE INVENTION

This invention provides a golf club head comprising a striking face section, a sole, and a flange extending about the periphery of the sole. The flange decreases in height from the upper edge of the striking face section to the back edge of the sole. A composition insert is secured within the front of the striking face section and is supported by a rim encircling an opening in the striking face. The club head may be made with a solid striking face without an insert if made from a metal having a high strength/density ratio.

DETAILED DESCRIPTION OF THE PREFERRED EMBODIMENT

Figure 1:
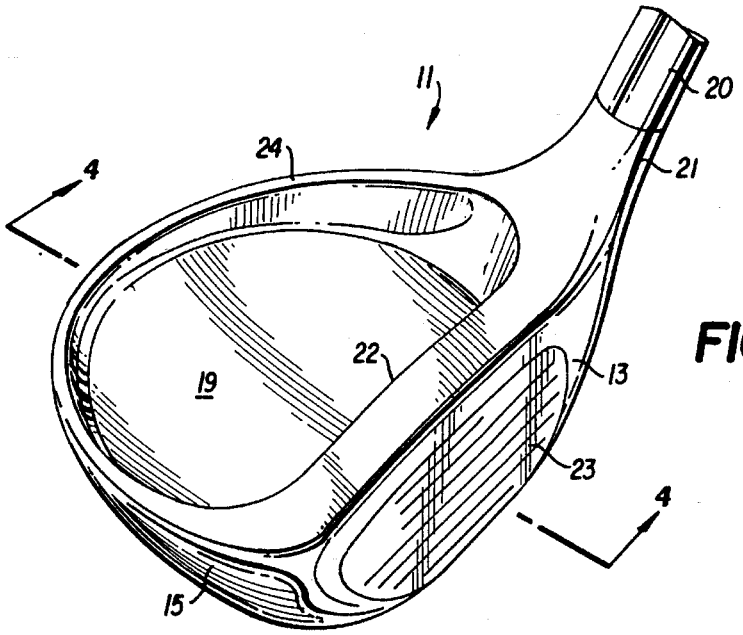
FIG. 1 is a perspective view of one embodiment of the club head of the present invention.

Club head 11 comprises a face section which includes striking face 13, toe 15, heel 17, and sole 19. A partial view of shaft 20 is shown as secured to hosel 21. Front section 24 is of a substantial thickness T (FIG. 4) and includes upper rim 22. Composition insert 23 having a thickness t is fixed in a designated cavity in the face of the club, as more clearly shown in FIG. 4. Flange 24 extends around the periphery of sole 19 and decreases in height from the ends of rim 22 down to the back edge of sole 19. As will be evident, this structure creates a crownless wood type club.

Figure 2:
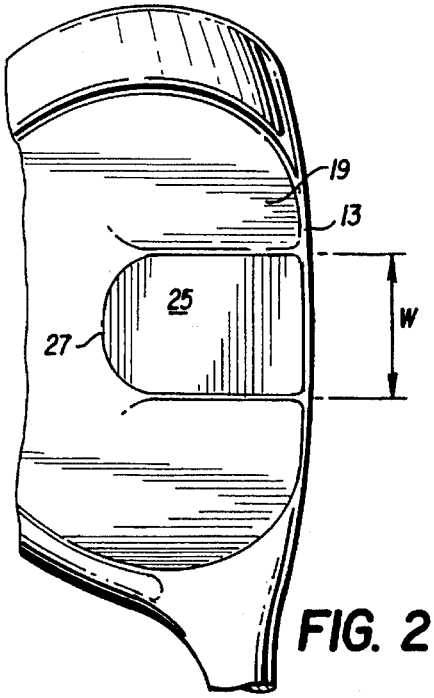
FIG. 2 is a partial bottom view of the club head of FIG. 1.

FIG. 2 is a bottom view of sole 19. This includes a flat planar surface 25 which extends from striking face 13 towards the center of the sole and terminates in arcuate edge 27. While this is a flat surface, it is smoothly integrated into the remainder part of the sole.

Figure 3:
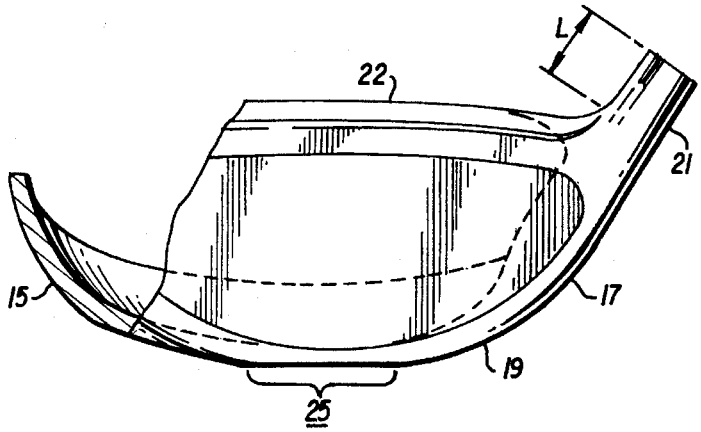
FIG. 3 is a partial cutaway front view of the club head of FIG. 1.

FIG. 3 illustrates the configuration of sole 19 with flat planar surface 25 and also indicates the general configuration of toe 15.

Figure 4:
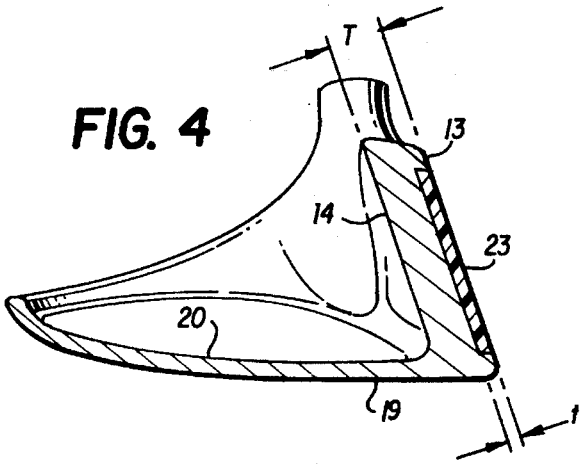
FIG. 4 is a sectional view taken through lines 4—4 of FIG. 1.

Referring to FIG. 4, striking face section 13 is of a thickness T and composition insert 23 has a thickness t. The thickness T of striking face section 13, when made of an aluminum/graphite composition, is from 0.100 inch to 0.500 inch, and preferably from 0.150 inch to 0.400 inch, with the preferred thickness being substantially 0.375 inch. If steel is used, thickness T would be reduced.

Composition insert 23 is made of a lower density, higher strength material than the base material of the club head so as to provide low/rear weight distribution.

The thickness t of composition insert 23 is from 0.060 inch to 0.250 inch, and preferably from 0.100 inch to 0.200 inch, with the preferred thickness being 0.175 inch. Graphite may also be used for the insert material.

Use of insert composition 23 improves the striking qualities of the club and reduces vibrations which would be inherent in a club so structured with a pure metal face and face section.

While the club head illustrated includes a hosel, it is to be understood that the basic head configuration may be hoseless.

If a hosel is used in the present club as shown, it is substantially shorter than the standard hosel and preferably has a length L of substantially 0.500 inch.

The above-described club provides desirable playing characteristics in that the center of gravity of the club head is positioned low and rearwardly with a high moment of inertia. Additionally, the present club head costs less to manufacture than the standard club head since it can be molded in one piece so as to eliminate sole plate assembly and weight adjustment. Numerous patterns may be used having different sole thicknesses so as to accommodate different weight categories.

Figure 5:
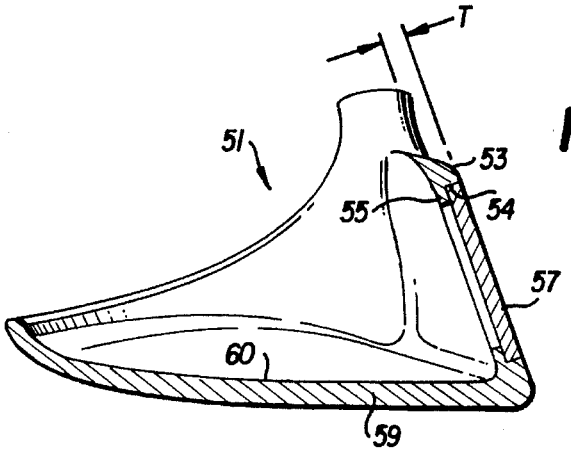
FIG. 5 is a sectional view of a modification of the club head of FIG. 1.

The center of gravity of the club head may be positioned lower and more rearwardly by using a face insert of sufficient strength so that no support backing by the base material would be required. One embodiment of this configuration is shown in FIG. 5.

The striking face of base club 51 includes outer rim 53, which terminates at its inner surface 54 in flange 55. Insert 57 is secured to flange 55 by means such as bonding. The outer edge surface of insert 57 is substantially flush with the outer surface of rim 53.

Materials used for insert 57 are of a sufficient strength so that no support backing by the base material is required. One such material is 6-4 titanium. The thickness of the titanium is between 0.060 inch and 0.250 inch, and is preferably 0.12 inch.

Figure 6:
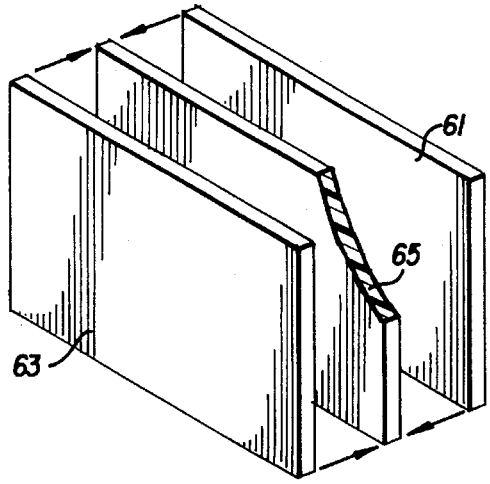
FIG. 6 is a perspective view of an insert used in the club head of FIG. 5.

An insert made of a sandwich construction such as shown in FIG. 6 may also be used. Outer sheets 61 and 63 are of 6-4 titanium having a thickness between 0.025 inch and 0.100 inch, and preferably 0.040 inch. Center 65 is a bonding and filling medium of compression molded graphite.

Figure 7:
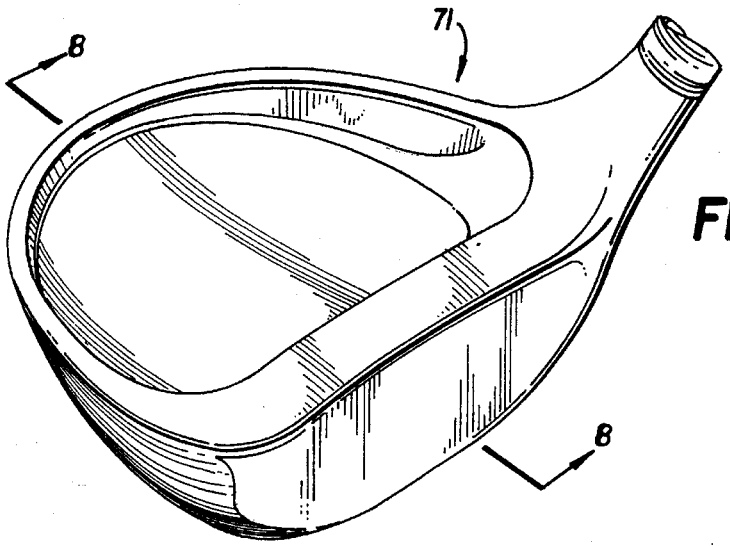
FIG. 7 is a perspective view of a modification of the club head of FIG. 1.

FIG. 7 illustrates a further embodiment of the invention wherein club head 71 is of substantially the same configuration as the club head of FIG. 1, except that no insert is used. Through the use of high-strength, light-weight materials, the weight redistribution and cosmetic shaping of the design can be achieved without a face insert being incorporated in the club head.

Figure 8:
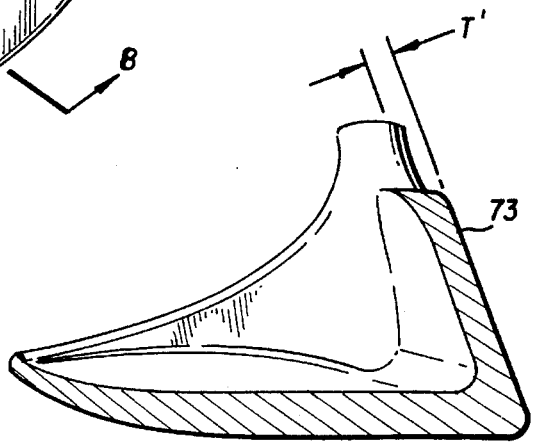
FIG. 8 is a sectional view taken through the lines 8—8 of FIG. 7.

As shown in FIG. 8, the thickness T' of face 73 is minimized and the major portion formerly used for face durability can be repositioned to achieve optimum weight distribution.

Materials used for this modification can consist of titanium alloys, metal matrix composites, or other novel high strength-to-weight ratio materials. The club head can be formed by investment casting, forging, or powdered metal processing.

The thickness T' is between 0.060 inch and 0.180 inch and preferably 0.120 inch.

As discussed above, a crownless club has been made using a standard aluminum alloy. A comparison of such an alloy with materials recently available for the golf market is presented below:

| MATERIAL | ULTIMATE STRENGTH LB/SQ. IN. | DENSITY LB/CU. IN. | STRENGTH/ DENSITY |
|---|---|---|---|
| 6-4 TITANIUM | 170000 | 0.1600 | 1062500 |
| 20% AL-2 O-3/ 6061 | 54000 | 0.0975 | 553846 |
| A201 ALUMINUM | 67000 | 0.1000 | 670000 |
| STD. ALUMINUM ALLOY | 33000 | 0.1000 | 330000 |

As can be seen, the first three commercially available materials have a much higher strength/density than does standard aluminum.

The above description and drawings are illustrative only and the invention is to be limited only by the scope of the following claims.

I/We claim:

1. A golf club head formed of a base material comprising a striking face section having a thickness T;

a sole extending rearwardly from a bottom of said face section;

a flange extending upwardly about the periphery of said sole to the back of said striking face section, said flange decreasing in height from said back of said striking face section to a back edge of said sole, said flange, said sole, and said back of said face section collectively forming an upwardly exposed cavity in said club head;

an opening having an inner surface in said striking face section;

a rim projecting from said inner surface of said opening; and an insert of a predetermined thickness in said striking face section secured to said rim, said insert having a substantially higher strength\density ratio than the base material of said club head.

2. The golf club head of claim 1 wherein said insert is a titanium alloy.

3. The golf club head of claim 1 wherein said insert is a sandwich configuration comprising outer titanium alloy plates secured together by compression-molded graphite.

* * * * *